US005911749A

United States Patent [19]

Sugie

[11] Patent Number: 5,911,749

[45] Date of Patent: Jun. 15, 1999

[54] AUGER-TYPE ICE MAKER

[75] Inventor: Hiroyuki Sugie, Peach Tree City, Ga.

[73] Assignee: Hoshizaki Denki Kabushiki Kaisha, Aichi-ken, Japan

[21] Appl. No.: 08/996,290

[22] Filed: Dec. 22, 1997

[30] Foreign Application Priority Data

Dec. 27, 1996 [JP] Japan ..... 8-350939

[51] Int. Cl.[6] ..... F25C 1/14

[52] U.S. Cl. ..... 62/354

[58] Field of Search ..... 62/66, 71, 341, 62/354

[56] References Cited

U.S. PATENT DOCUMENTS 5,394,708 3/1995 Whinery et al. ..... 62/354

*Primary Examiner*—Henry A. Bennett
*Assistant Examiner*—Mark Shulman
*Attorney, Agent, or Firm*—Wenderoth, Lind & Ponack, L.L.P.

[57] ABSTRACT

An auger-type ice maker comprises partitions 16 projectingly provided on the outer periphery of a pressing head 9 which has been inserted and fixed to the upper portion of an ice-making cylinder 1, wherein fixed blades 25 are formed at the lower portion of the partitions 16 so as to be offset in the radial direction, and wherein the tip of the inner circumference side portion 20*a* thereof is situated above the greater diameter portion of the auger 6 provided with a spiral blade 5. In the above construction, the offset corner portion 20*c* is provided with a curvature. Accordingly, ice can be prevented from being compressed to and adhering to the corner portion 20*c*. Thus, the transporting resistance of ice at the lower portion of the partitions projectingly provided to the outer periphery of the pressing head can be reduced, thereby preventing decreasing in ice-making capabilities and abnormal sounds or vibrations being emitted owing to ice jamming occurring.

2 Claims, 4 Drawing Sheets

AUGER-TYPE ICE MAKER

BACKGROUND OF THE INVENTION

1. Field of the Invention

The present invention relates to an auger-type ice maker, and particularly to the form of the lower edge of partitions protrudingly provided to the outer periphery of the pressure head.

2. Description of the Related Art

An example of a known auger-type ice maker is described in Japanese Utility Model Application Laid-open No. 56-163269.

This auger-type ice maker is, as shown in FIG. 1 of the above application, formed such that an ice compressing head (pressing head) is fixedly inserted into the upper portion of the ice-making cylinder. Partitions (side walls) are protrudingly provided at the outer periphery of the ice compressing head, and a compressing channel is formed between the partitions and the inner circumference wall of the ice-making cylinder. Also, an auger mechanism is inserted inside the ice-making cylinder which is wrapped with an evaporator on the outside thereof, this auger having a spiral blade on the outer periphery thereof and being formed with a small diameter on the top and bottom portions thereof which are inserted into bearings, and with a larger diameter portion at the middle thereof. The ice which has frozen onto the inner circumference wall of the ice-making cylinder is scraped off by the auger and sequentially transported upwards, pressed in the compressing channel, and continuously sent out from the upper end of the pressing head as an ice mass. Also, with this auger-type ice maker, in order to prevent ice pieces from rotating synchronously with the auger mechanism before the ice compressing head so that the upward movement thereof stops and generating of an ice mass becomes difficult, protruding pieces (fixed blades) extending a certain distance downward are provided on the bottom portion of the partitions protrudingly provided at the outer periphery of the ice compressing head.

Also, the arrangement is such that the ice transported upwards by the auger mechanism is guided upwards by the protruding pieces and proceeds along the compressing channel.

However, with the above-described auger-type ice machine, the lower portion of the partitions to which the protruding pieces are attached is of a normal partition structure at the inner side portion positioned above the large diameter portion of the auger mechanism. Also, the outer periphery side portions, positioned in the gap formed between the auger mechanism and the inner circumference wall of the ice-making cylinder, are protruding pieces. Accordingly, the inner circumference side portions and the protruding pieces (outer periphery side portions) are constructed so as to be offset one from another. However, no particular consideration has been given to the offset corner portions, and as can be seen in FIG. 1 of the aforementioned application, the corner portions are sharp right angles.

Accordingly, there has been the possibility for trouble wherein, in the process of the ice being transported upwards from the auger mechanism guided upwards by the protruding pieces and progressing through the compressing channel, the ice is pressed against this corner portion due to the angle portion-s being formed offset and sharp, resulting in the transportation of ice being inhibited.

In the event that ice becomes pressed against the offset corner portions, the ice-making load such as the load placed upon the ice-making cylinder, ice compressing head, etc. and the driving load of the driving mechanism of the auger mechanism increase, which has been a problem since the life expectancy of these members is shortened. Also, with such an arrangement, due to the transportation of ice being inhibited, ice jamming may occur, resulting in a decrease in ice-making capabilities, and abnormal sounds or vibrations being emitted.

SUMMARY OF THE INVENTION

Accordingly, the present invention has been made in view of the problems existing in the known art, and it is an object of the present invention to reduce the transportation resistance of the ice at the lower portion of the partitions protrudingly provided at the outer periphery of the pressing head, thereby preventing a decrease in ice-making capabilities and abnormal sounds or vibrations being emitted owing to ice jamming occurring.

In order to achieve the above objects, according to a first aspect of the present invention, an auger-type ice maker comprises: an ice-making cylinder; an evaporator provided at the outer periphery of the ice-making cylinder; an auger formed such that a middle portion in the vertical direction is of a greater diameter, and with a spiral blade on the outer periphery thereof, the auger being located within the ice-making cylinder; and a pressing head, inserted into the upper portion of the ice-making cylinder, thus forming a compressing channel between a plurality of partitions protrudingly formed at the outer periphery of the pressing head; wherein the lower end of a portion of the partitions are formed offset in the radial direction, so that the inner circumference side portion thereof is positioned above the greater diameter portion of the auger having the spiral blade, and the tip thereof is of a form tapering downwards, the outer periphery side portion thereof being positioned in the gap formed between the inner circumference wall of the ice-making cylinder and the auger, and also the tip thereof being a fixed blade tapering a certain length downward through the gap; and wherein the ice formed on the inner circumference wall of the ice-making cylinder is scraped off by the auger and sequentially transported upwards, sent into the compressing channel via the fixed blade, and continuously sent out from the upper end of the pressing head as an ice mass; and wherein the offset corner portion of the lower end of the partitions is rounded.

Also, according to a second aspect of the present invention, the inner circumference side portion of the partitions is formed in a tapered form when viewed from the side of the pressing head, and the tip portion thereof is curved.

The term "curved" in the first and second aspects of the present invention indicate an arc of a small radius, and this term will be used in this specification.

Thus, according to the auger-type ice maker such as described above, the ice formed on the inner circumference wall of the ice-making cylinder is scraped by the spiral blade of the auger during operation and is sequentially transported upwards, and sent into the compressing channel formed on the outer periphery of the pressing head, upon which this ice comes into contact with the side plane of the fixed blade formed at the outer periphery side portion of the lower end portion of the partitions formed on the outer periphery of the pressing head, so that the resistance prevents the rotation thereof with the auger, and also the ice is guided upwards by means of the tapered plane to the side plane of the fixed blade. Also, at the point of entering the compressing channel from the fixed blade portion, the offset corner portion of the outer periphery side portion and inner circumference side portion of the partitions provided on the pressing head are formed in a curved manner, so that the ice is smoothly transported upwards without being compacted against the offset corner portion. Accordingly, the transport resistance is markedly reduced, thereby preventing from a decrease in ice-making capabilities and abnormal sounds or vibrations being emitted owing to ice jamming occurring.

DESCRIPTION OF THE PREFERRED EMBODIMENT

A specific embodiment of the present invention carried out in an auger-type ice maker will be described in detailed with reference to FIGS. 1 through 5.

Figure 1:
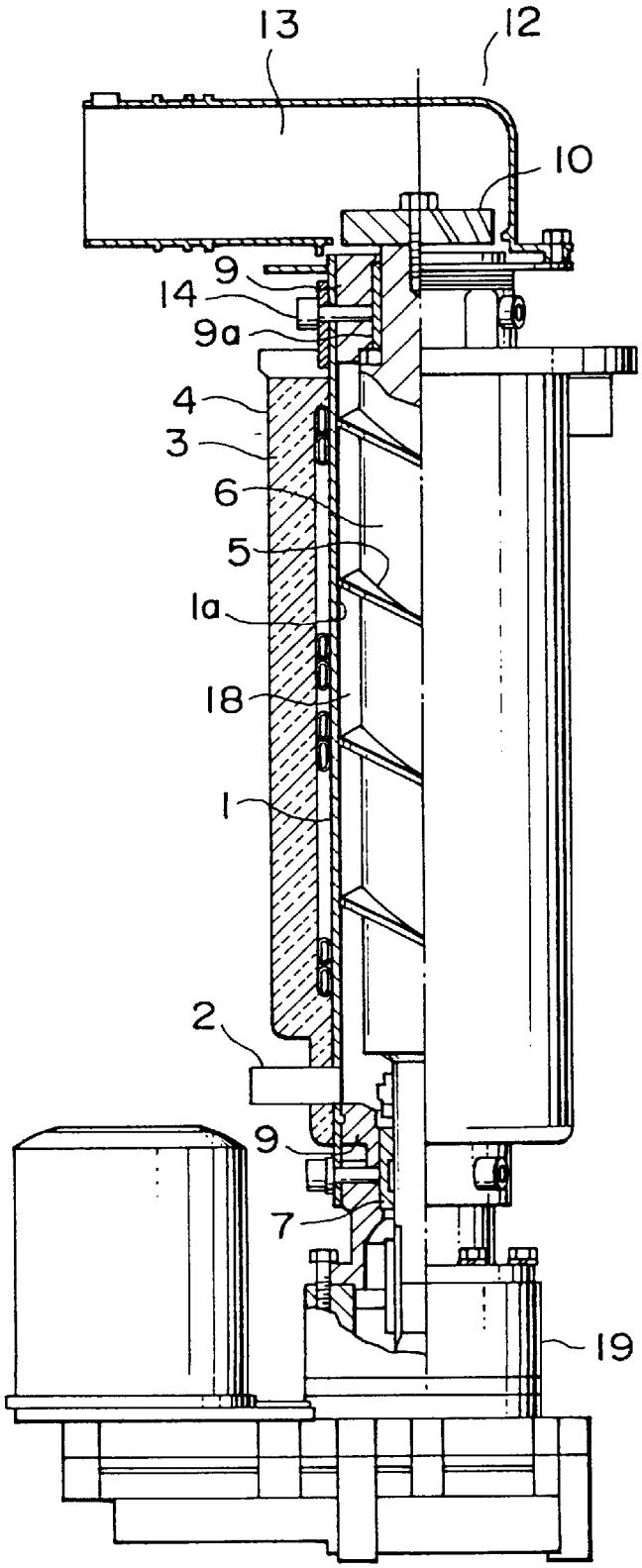
FIG. 1 is a cross-sectional view of the auger-type ice maker relating to an embodiment of the present invention.

In FIG. 1, 1 denotes the ice-making cylinder of an auger-type ice maker. This ice-making cylinder is provided with a water supply tube 2 at the lower portion thereof, and surrounded by an evaporator 3, with the outer periphery thereof being encased in thermal insulating material 4. Ice is formed on the inner circumference wall 1*a* of the ice-making cylinder 1, creating a thin ice layer.

Also provided within the ice-making cylinder 1 is an auger 6 formed with a small diameter on the top and bottom portions thereof, and a larger diameter portion at the middle. The lower end of the auger 6 which is of a small diameter is fit into a bearing 7, and the upper end thereof which is of a small diameter is fit into a bearing 9*a* fittably fixed into a hole on the center portion of the pressing head 9. The auger 6 also has a spiral blade 5 formed on the outer periphery of the portion with a large diameter. Rotating this auger 6 by means of a geared motor 19 which is provided below the ice-making cylinder to serve as a driving mechanism causes the thin ice layer frozen onto the inner circumference wall 1*a* of the ice-making cylinder 1 to be scraped off by the spiral blade 5, whereby the gap 18 between the outer periphery of the auger 6 and the inner circumference wall 1*a* of the ice-making cylinder 1 serves as an ice transporting channel through which the ice is transported upwards.

Figure 2:
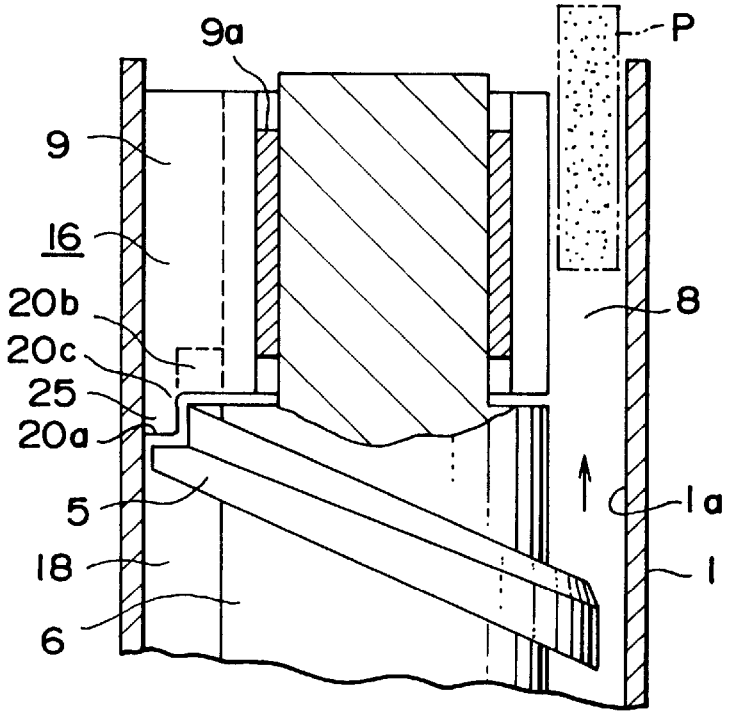
FIG. 2 is an enlarged view of the vicinity of the pressing head of the auger-type ice maker shown in FIG. 1.
Figure 3:
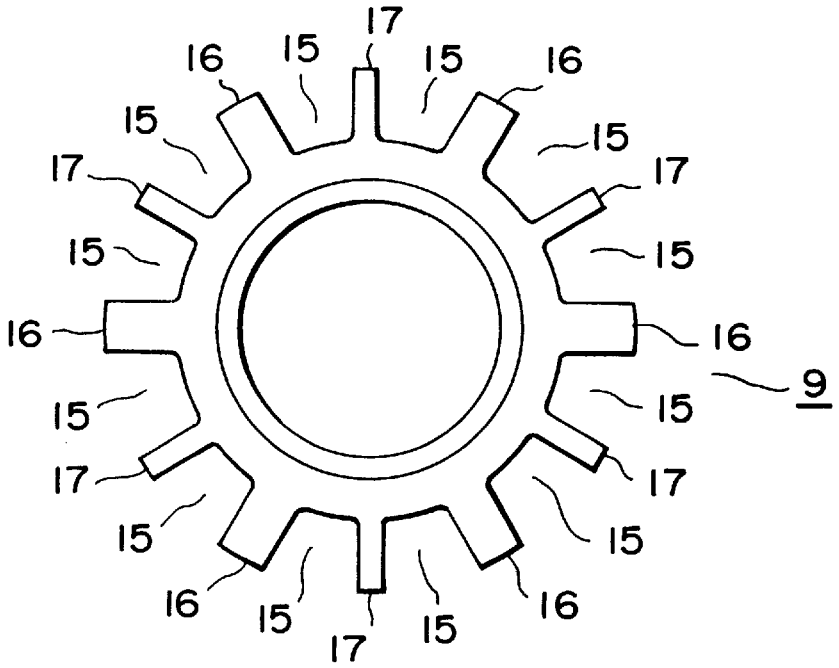
FIG. 3 is a plan view of the pressing head of the auger-type ice maker shown in FIG. 1.

The aforementioned pressing head 9 is inserted into the upper portion of the ice-making cylinder 1, and is detachably fixed by a screw 14. Also, as shown in FIGS. 2 and 3, relatively wide partitions 16 and narrow partitions 17 are alternately arrayed on the outer periphery of the pressing head 9, so that grooves 15 are formed between these partitions 16 and 17. Inserting the pressing head into the upper portion of the ice-making cylinder 1 causes the aforementioned grooves 15 to form compressing channels 8.

Figure 6:
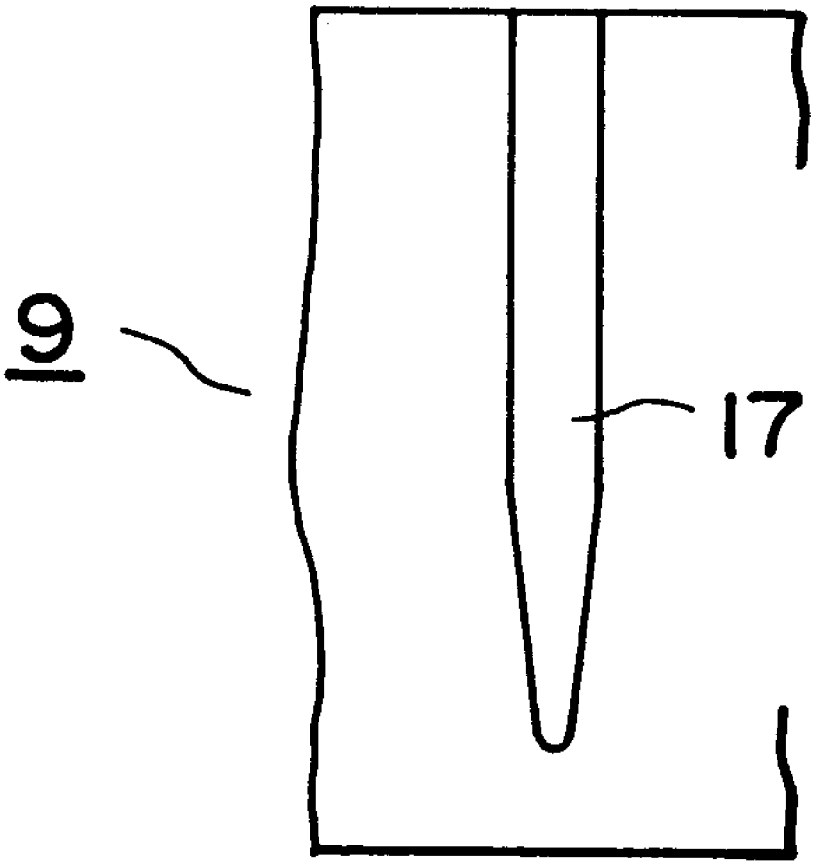
FIG. 6 is a diagram viewing from the side of the pressing head a narrow partition projectingly provided on the outer periphery of the pressing head of the auger-type ice maker shown in FIG. 1.

The aforementioned narrow partitions 17 are, as can be understood from FIG. 6, formed such that the tips thereof are tapered when viewed from the side of the pressing head 9.

Also, the aforementioned wide partitions 16 are, as can be understood from FIGS. 2 through 5, formed offset in the radial direction at the bottom plane of the lower portion 20 thereof, such that the inner circumference side portion 20*b* is positioned above the large diameter portion of the auger 6, and the outer periphery side portion 20*a* is positioned in the gap formed between the inner circumference wall 1*a* of the ice-making cylinder 1, i.e., the gap 18 serving as the ice transporting channel.

That is to say, this outer periphery side portion 20*a* extends downward in the gap 18 for a certain length, is tapered symmetrically when viewed from the side of the pressing head 9 (see FIG. 5), and is constructed as a so-called fixed blade 25. The tip of this fixed blade 25 is formed with a curvature of a small radius, in order to improve the strength thereof.

Also, the inner circumference side portion 20*b* is tapered symmetrically when viewed from the side of the pressing head 9 (see FIG. 5), is formed with a curvature of a small radius, with consideration to safety in handling, and in order to improve the workability and strength thereof, and is positioned above the large diameter portion of the auger 6 so as not to come into contact with the auger 6.

Figure 4:
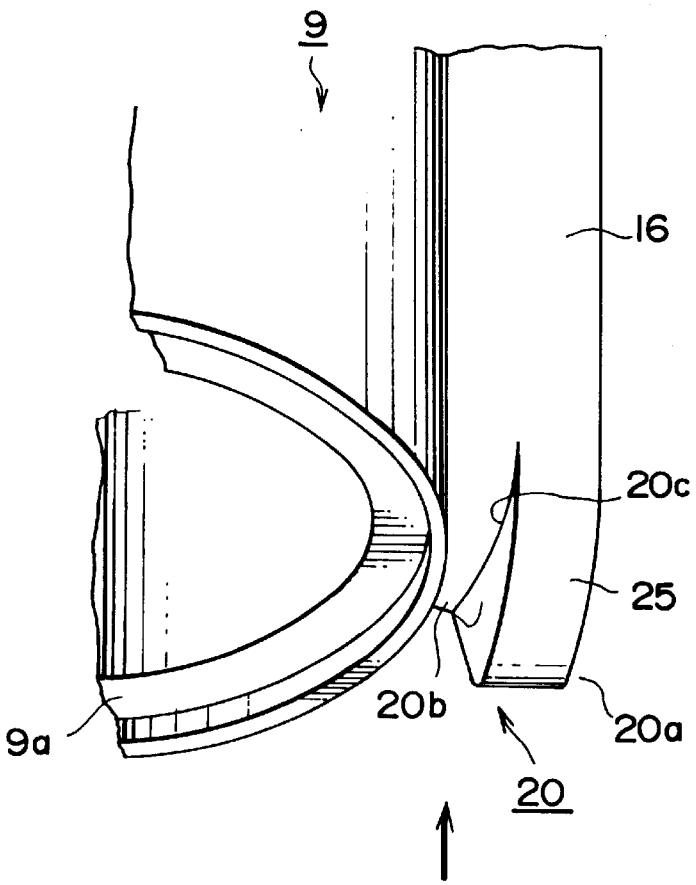
FIG. 4 is an enlarged perspective view of the lower portion of a relatively wide partition projectingly provided on the outer periphery of the pressing head of the auger-type ice maker shown in FIG. 1.
Figure 5:
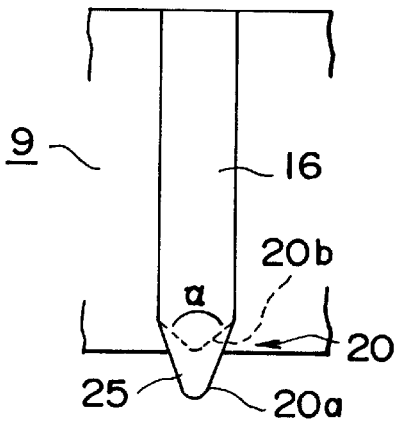
FIG. 5 is a diagram viewing the partition in FIG. 4 from the side of the pressing head.

Also, the corner portion 20*c* of the offset is also formed as a curvature with a small radius (See FIG. 4).

The pressing head constructed thus is formed by a lost-wax process, for example.

Also, in FIG. 1, 12 denotes a guide cylinder for guiding the compressed solid ice discharged from the pressing head into an unshown ice storage bin, and has an L-shaped discharge channel 13. The lower portion of the discharge channel 13 is fixed to the upper portion of the ice-making cylinder 1.

Also, provided at the entrance side of the discharge channel 13 is a cutter 10 for breaking the compressed solid ice which is discharged from the pressing head 9 as a rod-shaped ice mass P, this cutter 10 being attached to the upper plane of the upper small diameter portion of the aforementioned auger 6, so as to rotate integrally with the auger 6.

Next, description will be made regarding the operation of the above-described auger-type ice maker. At the point that the geared motor 19 which is provided to serve as a driving mechanism is driven and the ice-making operation is started, water for forming ice is supplied into the ice-making cylinder 1 from the water supply tube 2. The water for forming ice which has been supplied to the ice-making cylinder 1 is depleted of its heat by the evaporator 3 provided around the ice-making cylinder 1, and gradually freezes as a thin ice film on the inner circumference wall 1*a* of the ice-making cylinder 1. The thin ice frozen onto the inner circumference wall 1*a* of the ice-making cylinder 1 as described above is then scraped by the spiral blade 5 of the auger 6 rotated by the geared motor 19, becoming sherbet-like ice which is transported upwards as shown by the solid arrow in FIGS. 2 and 4. Then, the ice comes into contact with the solid blade 25 before the pressing head 9, so that the ice is prevented from moving with the auger 6 due to the resistance of the solid blade 25, whereby the ice is guided by the tapered plane of the solid blade 25 into the compressing channel above.

Now, at the lower portion 20 of the partitions 16 projectingly provided on the outer periphery of the pressing head 9, the inner periphery side portion 20*a* is tapered downwards, so ice transported upwards from the auger is guided into the compressing channel 8 above, following the tapered plane of the inner periphery side portion 20*a*. Incidentally, this tapered angle α (see FIG. 5) is preferably 45° to 80°. If the angle is smaller than 45°, the strength is not sufficient, and if the angle exceeds 80°, reduction of the transportation resistance of the ice cannot be realized to any practical extent. Also, forming the tapered tip thereof with a curvature of a small radius does away with any danger during handling, secures the strength thereof, and improves the ease of manufacturing. Further, based on experimental data, the curvature should be between around 0.5 mm to 0.8 mm.

Also, the offset angle portion 20*c* at the lower portion of the partition 16 is also provided with a curvature with a small radius, so the ice sent from the auger 6 to the fixed blade 25 does not freeze and adhere to this angle portion 20*c*, and thus the transpiration resistance of the ice at the cross-section changing portion in the ice transportation channel is reduced. Further, based on experimental data, the curvature should be around 2 mm.

Thus, the ice is transported into the compressing channel 8. Passing through the compressing channel 8 compresses the ice with great hardness and high transparency. This ice is pressed by the ice subsequently entering the compressing channel 8, moves upward through the compressing channel 8, and is sent out of the upper portion of the pressing head 9 as a cylindrical ice mass P. Provided at the upper side of the compressing channel 8 is the cutter 10, whereby the ice mass P is cut into the desired size, and the cut ice passes through the discharge channel 13 and is guided to an unshown ice storage bin.

The present invention is constructed as described above, and thus has the following advantages:

According to a first aspect of the invention, the offset corner portions of the inner circumference side portion and outer periphery side portion at the lower portion of the partitions protrudingly provided on the outer periphery of the pressing head are formed with a curvature, so adhesion of ice to the offset corner portion is avoided, thereby reducing transportation resistance of the ice.

Also, according to the second aspect of the invention, the inner circumference side portion at the lower portion of the partitions is tapered, so that adhesion of ice on offset corner portion is avoided, thereby reducing transportation resistance of the ice.

What is claimed is:

1. An auger-type ice maker, comprising:

an ice-making cylinder;

an evaporator provided around the outer periphery of said ice-making cylinder;

an auger formed such that the middle portion in the vertical direction is of a greater diameter, with a spiral blade on the outer periphery thereof, said auger being located within said ice-making cylinder; and a pressing head, inserted into the upper portion of said ice-making cylinder, thus forming a compressing channel between a plurality of partitions protrudingly formed at the outer periphery of said pressing head;

wherein the lower end of said partitions are formed offset in the radial direction, so that the inner circumference side portion thereof is positioned above the greater diameter portion of the auger having the spiral blade, and the tip thereof is of a form tapering downwards, the outer periphery side portion thereof being positioned in the gap formed between the inner circumference wall of said ice-making cylinder and said auger, and also the tip thereof being a fixed blade tapering a certain length downward through said gap;

and wherein the ice formed on the inner circumference wall of said ice-making cylinder is scraped off by the auger and sequentially transported upwards, sent into said compressing channel via said fixed blade, and continuously sent out from the upper end of said pressing head as an ice mass;

and wherein the offset corner portion of the lower end of said partitions is rounded.

2. An auger-type ice maker according to claim 1, wherein said inner circumference side portion of said partitions is formed in a tapered form when viewed from the side of the pressing head, and the tip portion thereof is curved.

* * * * *